US010931022B1

(12) United States Patent
Kaddour et al.

(10) Patent No.: US 10,931,022 B1
(45) Date of Patent: Feb. 23, 2021

(54) RECONFIGURABLE ARRAYS WITH MULTIPLE UNIT CELLS

(71) Applicants: Abdul-Sattar Kaddour, Miami, FL (US); Constantinos L. Zekios, Miami, FL (US); Stavros Georgakopoulos, Miami, FL (US)

(72) Inventors: Abdul-Sattar Kaddour, Miami, FL (US); Constantinos L. Zekios, Miami, FL (US); Stavros Georgakopoulos, Miami, FL (US)

(73) Assignee: The Florida International University Board of Trustees, Miami, FL (US)

( * ) Notice: Subject to any disclaimer, the term of this patent is extended or adjusted under 35 U.S.C. 154(b) by 0 days.

(21) Appl. No.: 16/857,430

(22) Filed: Apr. 24, 2020

(51) Int. Cl.

| | |
|---|---|
| ***H01Q 15/16*** | (2006.01) |
| ***H01Q 3/01*** | (2006.01) |
| ***H01Q 15/14*** | (2006.01) |
| ***H01Q 21/22*** | (2006.01) |

(52) U.S. Cl.
CPC ..... *H01Q 15/161* (2013.01); *H01Q 3/01* (2013.01); *H01Q 15/148* (2013.01); *H01Q 21/22* (2013.01)

(58) Field of Classification Search
CPC ... H01Q 15/147; H01Q 15/148; H01Q 15/161
See application file for complete search history.

(56) References Cited

U.S. PATENT DOCUMENTS

2017/0025748 A1* 1/2017 Georgakopoulos ..... H01Q 1/36
2018/0278200 A1* 9/2018 Jeon ..... H02S 30/20

OTHER PUBLICATIONS

S. R. Seiler et al., "Physical reconfiguration of an origami-inspired deployable microstrip patch antenna array," 2017 IEEE International Symposium on Antennas and Propagation & USNC/URSI National Radio Science Meeting, San Diego, CA, 2017, pp. 2359-2360 (Year: 2017).*

* cited by examiner

*Primary Examiner* — Graham P Smith
*Assistant Examiner* — Amal Patel
(74) *Attorney, Agent, or Firm* — Saliwanchik, Lloyd & Eisenschenk

(57) ABSTRACT

Arrays that are deployable and can change their electromagnetic behavior by changing their shape are provided. The arrays can steer the beam using folding techniques and/or can achieve multiple operation states by folding the structure. An array can include a foldable substrate with antenna elements disposed thereon. In a folded state, a first plurality of unit cells is visible from above the array and can be configured to steer in a particular first direction and/or operate at a particular first frequency. In the unfolded state a second plurality of unit cells, and also possibly the first plurality of unit cells, are visible from above the array and can be configured to steer in a particular second direction and/or operate at a particular second frequency.

20 Claims, 10 Drawing Sheets

RECONFIGURABLE ARRAYS WITH MULTIPLE UNIT CELLS

GOVERNMENT SUPPORT

This invention was made with government support under Award Number FA9550-18-1-0191 awarded by the Air Force. The government has certain rights in the invention.

BACKGROUND

Cubesat missions for low earth orbit have seen explosive growth over the last decade as they offer new opportunities to expand space exploration and provide better telecommunication capabilities due to their short design time and low fabrication cost. Space communication systems need high gain antennas (HGAs) such as reflectarrays and parabolic reflectors. Reflectarrays are the most commonly used concept for CubeSat HGAs because they offer small stowed volume, low mass, and low cost. However, these reflectarrays radiate in only one pre-defined direction while in real applications multiple radiating directions are highly desired.

Typically, to steer the beam in different directions complicated feeding networks are required, such as beamformers. Beamformers can be either passive or active networks. Passive beamformers is an established technology used in phased arrays for the last 60 years. Active beamformers is a technology developed the last 20 years. Each of passive and active beamformers has its own advantages and disadvantages depending on the application. In the case of space applications, the most critical factors are reliability, cost, and power consumption. Even though these classical beamsteering techniques are reliable, the complexity of their designs is significantly high, resulting to increased power demands and cost.

BRIEF SUMMARY

Embodiments of the subject invention provide novel and advantageous arrays that are deployable and can change their electromagnetic behavior by changing their shape. The arrays can steer the beam using folding techniques and/or can achieve multiple operation states by folding the structure. The arrays can fold and unfold using any suitable actuation system known in the art (e.g., a motor or robotics). An array can include a foldable (e.g., an origami pattern) substrate with one or more antenna elements (e.g., an antenna element in each unit cell) disposed thereon. The foldable substrate can have predefined folding lines (e.g., folding lines for mountain- and/or valley-style folds) and/or hinges such that the foldable substrate can be folded into at least one particular predetermined shape in each folded state and can lay flat in an unfolded state. In a folded state, a first plurality of unit cells is visible from above the array and can be configured to steer in a particular first direction and/or operate at a particular first frequency. In the unfolded state a second plurality of unit cells (of a quantity greater than the first plurality of unit cells), and also possibly the first plurality of unit cells, are visible from above the array and can be configured to steer in a particular second direction and/or operate at a particular second frequency. The first direction can be different from the second direction and/or the first frequency can be different from the second frequency. In some embodiments, the first direction can be the same as the second direction or the first frequency can be the same as the second frequency. This concept can be extended to more than one folded state. The antenna elements and/or unit cells can have any suitable shape; for example, the unit-cell elements can have a rectangular, square, triangular, or circular lattice.

In an embodiment, an array can comprise: a foldable substrate configured to be folded and having predefined folding lines, hinges, or both, for folding into at least one predetermined configuration, such that the foldable substrate has an unfolded state and at least one folded state; a plurality of first unit cells disposed on the foldable substrate, each first unit cell comprising an antenna element; and a plurality of second unit cells disposed on the foldable substrate, each second unit cell comprising an antenna element. The foldable substrate can be configured such that, in a first folded state only the plurality of first unit cells is fully visible from above the array while the plurality of second unit cells is not fully visible from above the array. The foldable substrate can be further configured such that, in the unfolded state both the plurality of first unit cells and the plurality of second unit cells are fully visible from above the array. The array can be a reflectarray or a phased array. The antenna elements of the plurality of first unit cells can be configured to steer a beam in a first direction, and the antenna elements of the plurality of second unit cells can be configured to steer a beam in a second direction different from the first direction. Each first unit cell and each second unit cell can be, for example, a rectangular (e.g., square) unit cell, a triangular unit cell, or a circular unit cell. The array can also comprise an actuation system (e.g., a motor and/or robotics) configured to fold and unfold the foldable substrate. In a further embodiment, the array can further comprise a plurality of third unit cells disposed on the foldable substrate, each third unit cell comprising an antenna element. The foldable substrate can be configured such that, in a second folded state only the plurality of third unit cells is fully visible from above the array while the plurality of first unit cells and the plurality of second unit cells is not fully visible from above the array, and in the unfolded state all of the plurality of first unit cells, the plurality of second unit cells, and the plurality of third unit cells are fully visible from above the array. Each third unit cell can be, for example, a rectangular (e.g., square) unit cell, a triangular unit cell, or a circular unit cell. The antenna elements of the plurality of third unit cells can be configured to steer a beam in a third direction different from the first direction and the second direction.

In another embodiment, an array can comprise: a foldable substrate configured to be folded and having predefined folding lines, hinges, or both, for folding into at least one predetermined configuration, such that the foldable substrate has an unfolded state and at least one folded state; a plurality of core unit cells disposed on the foldable substrate, each first unit cell comprising a first antenna element; and a plurality of modified unit cells disposed on the foldable substrate, each modified unit cell respectively comprising a core unit cell of the plurality of core unit cells, each modified unit cell further comprising a second antenna element around the first antenna element of its respective core unit cell to form a modified antenna element. The foldable substrate can be configured such that, in a first folded state only the plurality of core unit cells is fully visible from above the array while the second antenna elements are not fully visible from above the array, and the foldable substrate can be configured such that, in the unfolded state the plurality of modified unit cells, including the second antenna elements, is fully visible from above the array. The array can be a reflectarray or a phased array. The first antenna elements can be configured to steer a beam in a first direction at a first frequency, and the modified antenna elements can be configured to steer a beam in a second direction at a second frequency, where the first direction is different from the second direction and/or the first frequency is different from the second frequency. Each core unit cell and each modified unit cell can be, for example, a rectangular (e.g., square) unit cell, a triangular unit cell, or a circular unit cell. The array can also comprise an actuation system (e.g., a motor and/or robotics) configured to fold and unfold the foldable substrate. The first antenna elements can be, for example, solid rectangular (e.g., square) antenna elements, and the second antenna elements can be, for example, rectangular-shaped (e.g., square-shaped) antenna elements respectively surrounding the first antenna elements.

DETAILED DESCRIPTION

Figure 1:
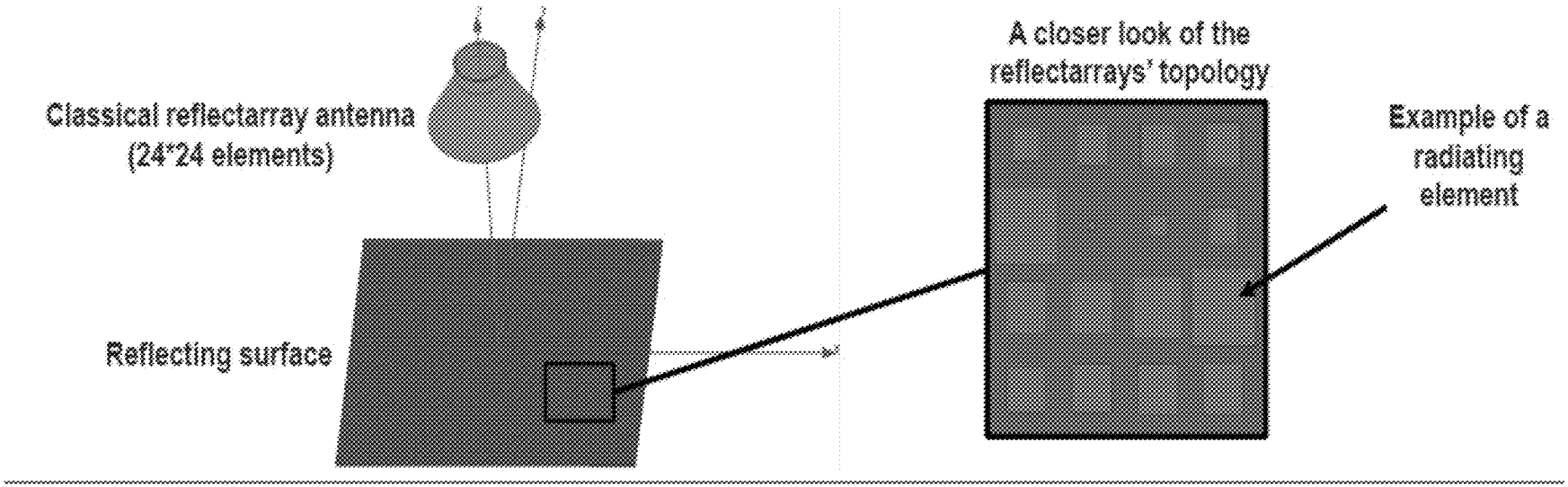
FIG. 1 is a schematic view showing an array and antenna.

Embodiments of the subject invention provide novel and advantageous arrays that are deployable and can change their electromagnetic (EM) behavior by changing their shape. The arrays can steer the beam using folding techniques and/or can achieve multiple operation states by folding the structure. The arrays can fold and unfold using any suitable actuation system known in the art (e.g., a motor or robotics). An array can include a foldable substrate (e.g., an origami substrate) with one or more antenna elements (e.g., an antenna element in each unit cell) disposed thereon. The foldable substrate can have predefined folding lines (e.g., folding lines for mountain- and/or valley-style folds) and/or hinges such that the foldable substrate can be folded into at least one particular predetermined shape in each folded state and can lay flat in an unfolded state. In a folded state, a first plurality of unit cells is visible from above the array and can be configured to steer in a particular first direction and/or operate at a particular first frequency. In the unfolded state a second plurality of unit cells (of a quantity greater than the first plurality of unit cells), and also possibly the first plurality of unit cells, are visible from above the array and can be configured to steer in a particular second direction and/or operate at a particular second frequency. The first direction can be different from the second direction and/or the first frequency can be different from the second frequency. In some embodiments, the first direction can be the same as the second direction or the first frequency can be the same as the second frequency. This concept can be extended to more than one folded state. By going from an unfolded state to a folded state, one or more electromagnetic characteristics/properties (e.g., the frequency of operation, the polarization, and the beam direction) of the array can be changed. The antenna elements and/or unit cells can have any suitable shape; for example, the antenna elements can have a rectangular, square, triangular, or circular lattice.

Instead of using one of the electronic feeding networks of the related art, which have the problems mentioned in the Background above, mechanical reconfiguration can be applied to steer the beam in a desired direction. Even though mechanical reconfiguration is slower compared to electronic reconfiguration, it is sufficient for space applications because the response time (due to the long distances) are much smaller than the response time of any mechanical rotor. In this case by appropriately rotating the reflectarrays or reflectors, the beam can be appropriately steered to the desired direction.

Arrays of embodiments of the subject invention can be applied on any foldable (e.g., origami) design or foldable structure, including but not limited to tessellations that have periodic patterns. At each folded state of the foldable substrate, a different array design is formed that provides different EM characteristics. At each folded state, the array comprises (i.e., shows visible from above) one respective type of antenna elements (a respective type of plurality of unit cells), while in the unfolded state the array comprises (i.e., shows visible from above) two or more types of antenna elements (e.g., antenna elements from all different folded states plus antenna elements that are not visible in any folded state). Radiating antenna elements can be any suitable type of printed antenna, including but not limited to patches and/or loops. The term "array" as used herein refers to phased arrays and reflectarrays. Any suitable substrate (rigid (with hinges) or flexible) can be used for the arrays, including but not limited to Duroid, Mylar, FR4, textiles, or Kapton. Any conductive material can be used for the arrays, including but not limited to copper, aluminium, silver, gold, or platinum. Any type of conductive antenna element can be used for the arrays, including but not limited to traces, tape, threads, inks, and/or liquid metals.

A reflectarray is an antenna with a flat or slightly curved reflecting surface and an illuminating feed antenna. Many radiating elements are typically present on the reflecting surface. The feed antenna spatially illuminates the radiating elements that are designed to reradiate and scatter the incident field with electrical phases that are required to form a planar phase front in the far-field distance. Several methods can be used for reflectarray elements to achieve a planar phase front. FIG. 1 shows an example of using variable sized radiating element patches so that the radiating elements can have different scattering impedances and, thus, different phases to compensate for the different feed-path delays.

Figure 2:
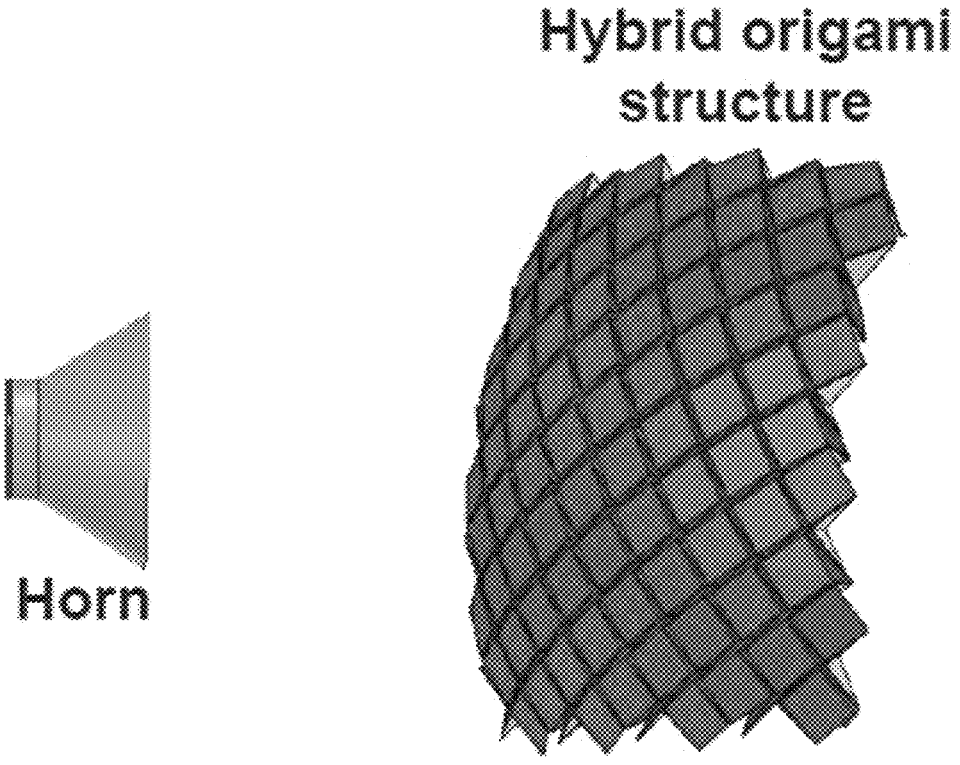
FIG. 2 is a schematic view showing an array according to an embodiment of the subject invention, depicted with a horn antenna.
Figure 3:
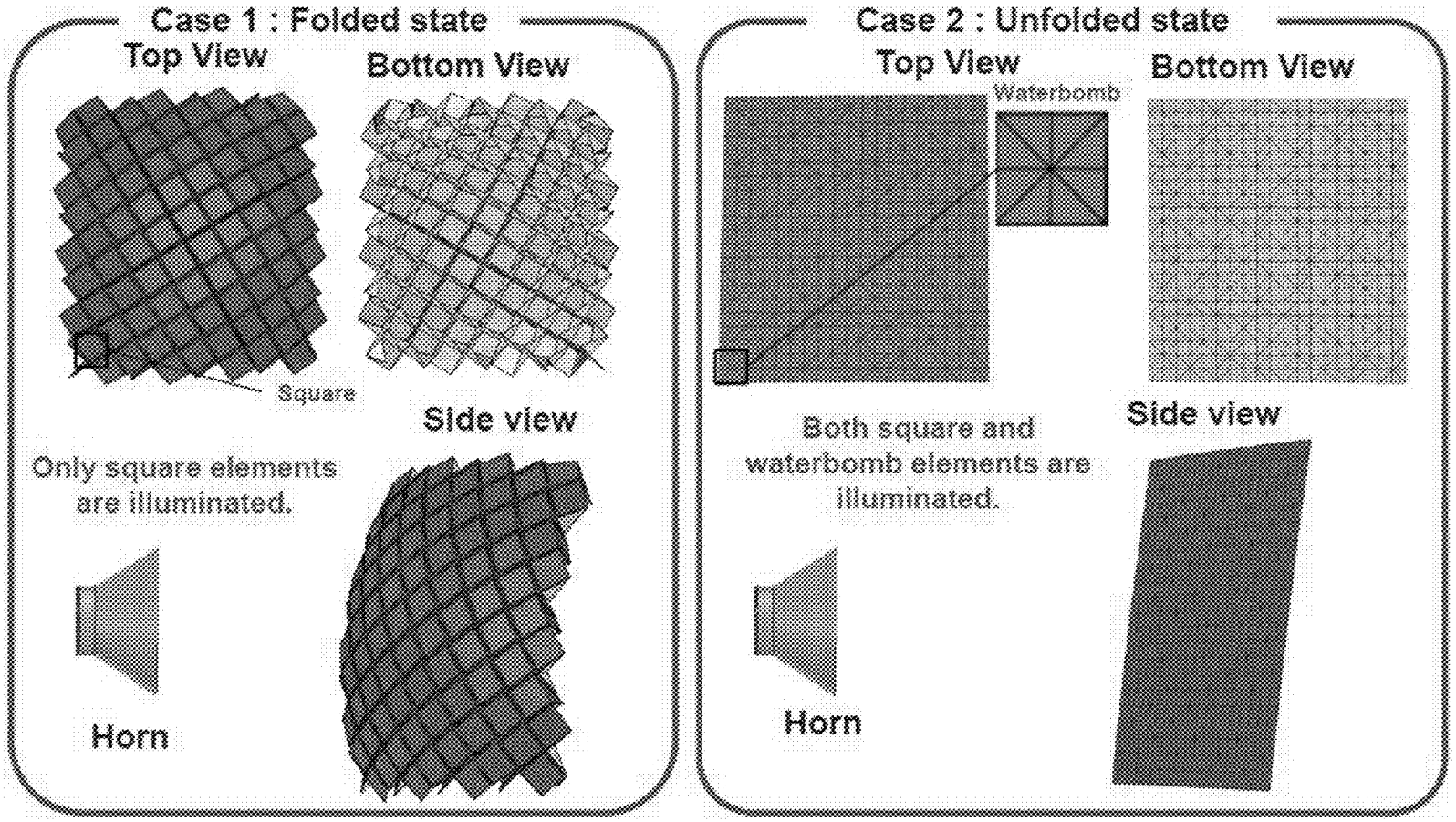
FIG. 3 shows a top view, bottom view, and schematic side view (with an antenna) of an array according to an embodiment of the subject invention, for both a folded state (labeled "Case 1") and an unfolded state (labeled "Case 2").

FIG. 2 is a schematic view showing an array according to an embodiment of the subject invention, depicted with a horn antenna, and FIG. 3 shows a top view, bottom view, and schematic side view (with an antenna) of the array of FIG. 2 for both a folded state (labeled "Case 1") and an unfolded state (labeled "Case 2"). The foldable substrate used for this array has folding lines for a waterbomb configuration (i.e., in the folded state the substrate is in the waterbomb configuration). The waterbomb configuration is an origami configuration that is known in the art of origami. Referring to FIG. 3, in the folded state only square elements are fully visible from above the substrate and therefore illuminated by the antenna. In the unfolded state, the full waterbomb elements (with the folding lines) are fully visible and therefore illuminated by the antenna.

Figure 4:
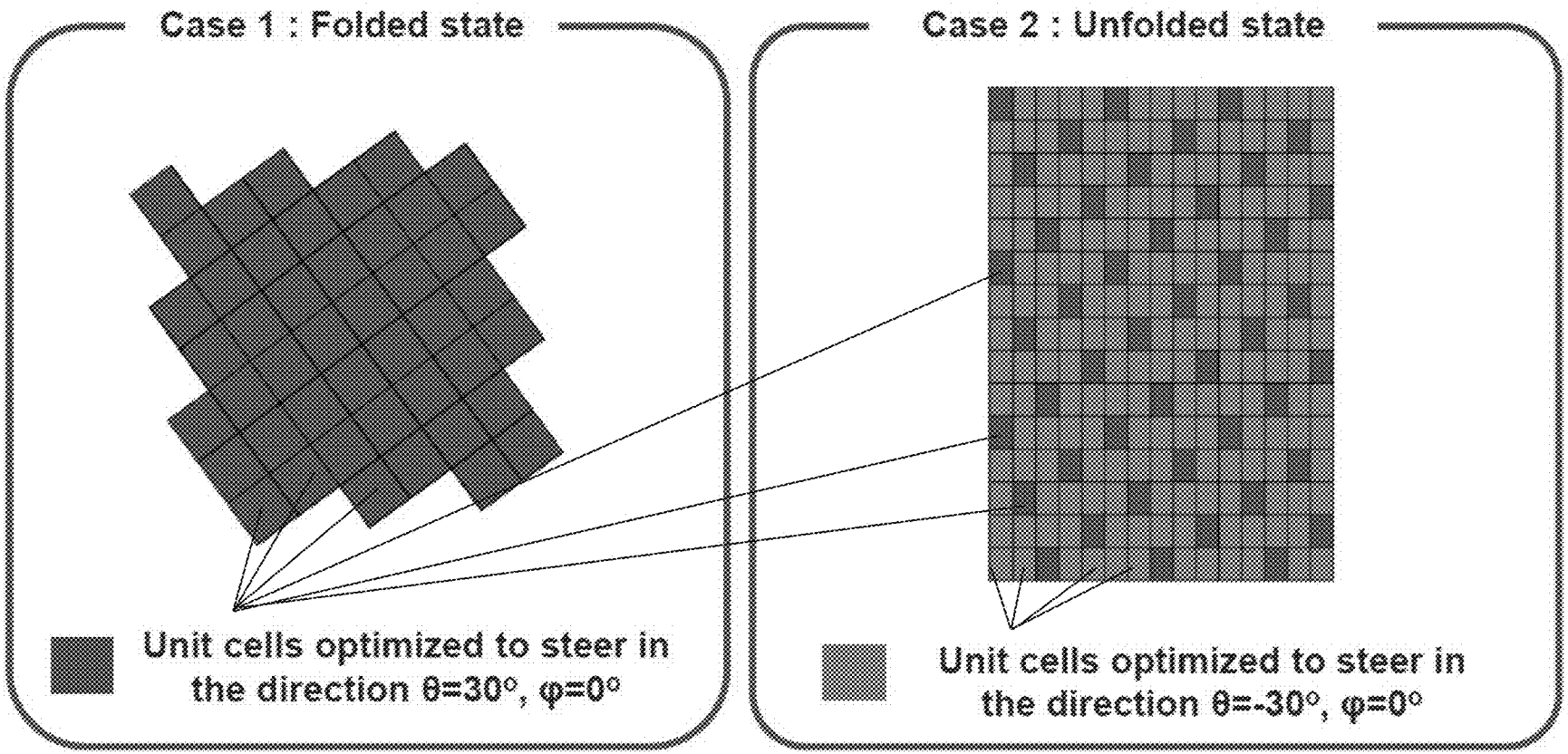
FIG. 4 shows top views of an array according to an embodiment of the subject invention, for both a folded state (labeled "Case 1") and an unfolded state (labeled "Case 2"). In the folded state all unit cells visible from above are optimized to steer in a particular direction (e.g., $\theta=30°$, $\phi=0°$). In the unfolded state all unit cells from the folded state are visible from above, but most of the unit cells visible from above are optimized to steer in a different particular direction (e.g., $\theta=-30°$, $\phi=0°$) from the only ones that are visible from above in the folded state.
Figure 5:
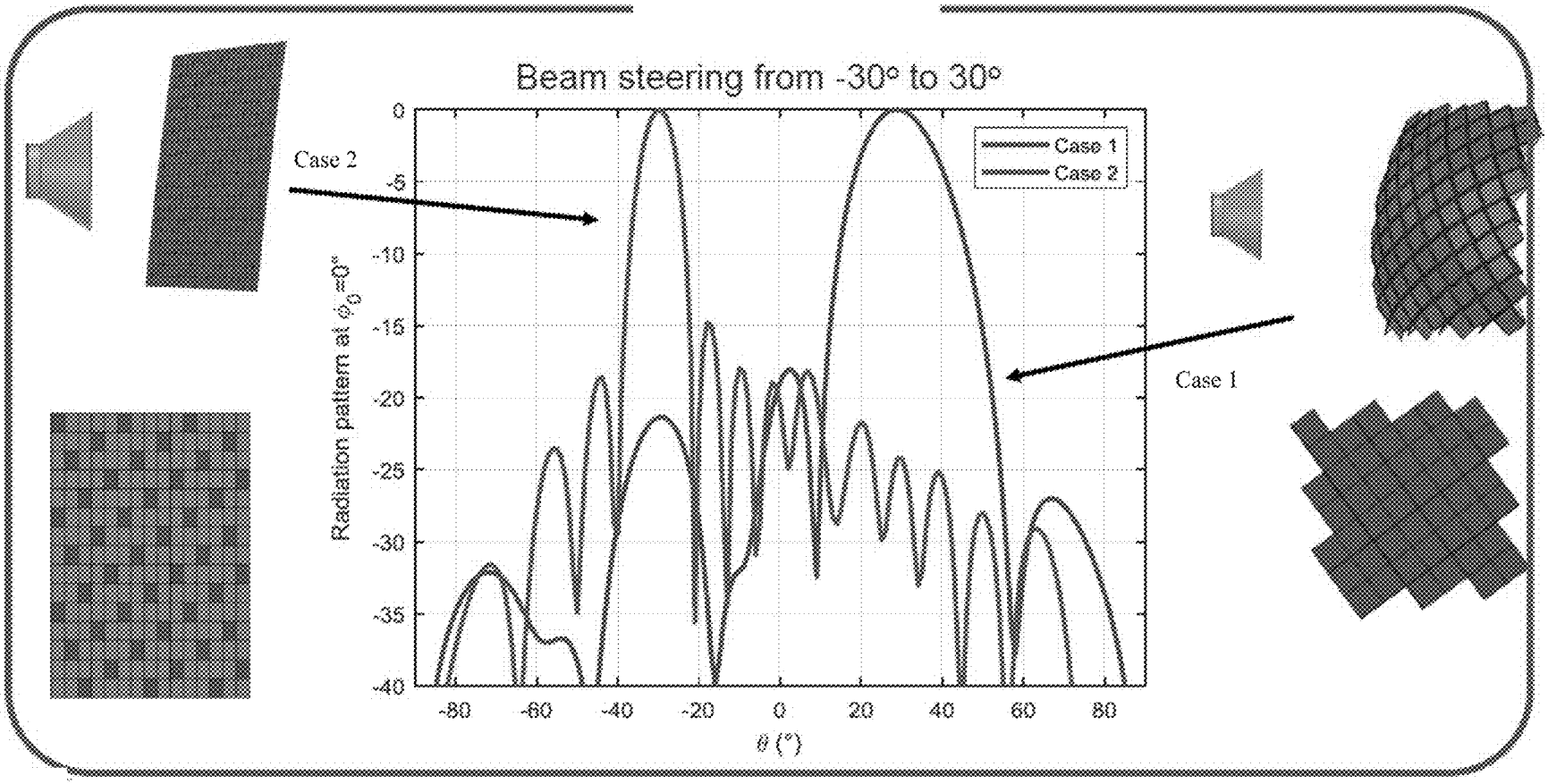
FIG. 5 is a plot of radiation pattern at $\phi_0=0°$ (in decibels relative to an isotropic radiator (dBi)) versus $\theta$ (in degrees), for the two cases depicted in FIGS. 3 and 4.

FIG. 4 shows top views of an array according to an embodiment of the subject invention, for both a folded state (labeled "Case 1") and an unfolded state (labeled "Case 2"). In the folded state all unit cells visible from above are optimized to steer in a particular direction (e.g., $\theta=30°$, $\phi=0°$). In the unfolded state all unit cells from the folded state are visible from above, but most of the unit cells visible from above are optimized to steer in a different particular direction (e.g., $\theta=-30°$, $\phi=0°$) from the only ones that are visible from above in the folded state. FIG. 4 is a more generalized depiction of the cases from FIG. 3. FIG. 5 is a plot of radiation pattern at $\phi_0=0°$ (in decibels relative to an isotropic radiator (dBi)) versus $\theta$ (in degrees), for the two cases depicted in FIGS. 3 and 4. Referring to FIG. 5, the folded state and the unfolded state steer the beam in different directions (i.e., different values of $\theta$).

Figure 6:
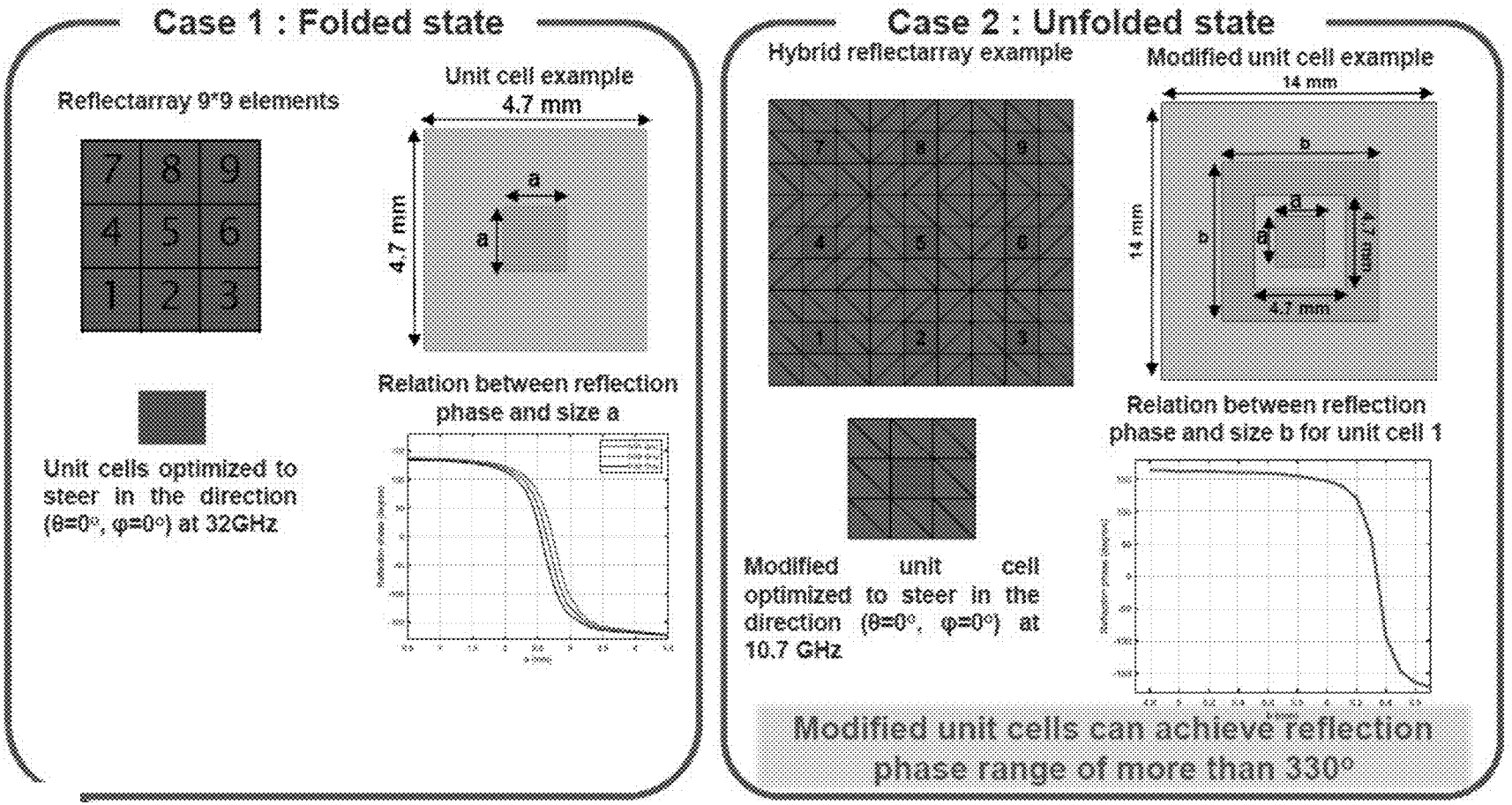
FIG. 6 shows top views of an array according to an embodiment of the subject invention, for both a folded state (labeled "Case 1") and an unfolded state (labeled "Case 2"). In the folded state all unit cells visible from above are optimized to steer in a particular direction and at a particular frequency (e.g., $\theta=0°$, $\phi=0°$, frequency=32 gigahertz (GHz)). In the unfolded state all unit cells from the folded state are visible from above, but they are now modified unit cells due to the portion of the substrate now surrounding the original unit cells (labeled "1" through "9" in FIG. 6). The modified unit cells are optimized to steer in a particular direction, which could be the same as the direction for the original unit cells in the folded state, and at a particular frequency (e.g., $\theta=0°$, $\phi=0°$, frequency=10.7 GHz). Although certain dimensions and arrangements (e.g., 9×9) are depicted in FIG. 6, these are shown for exemplary purposes only and should not be construed as limiting.
Figure 7:
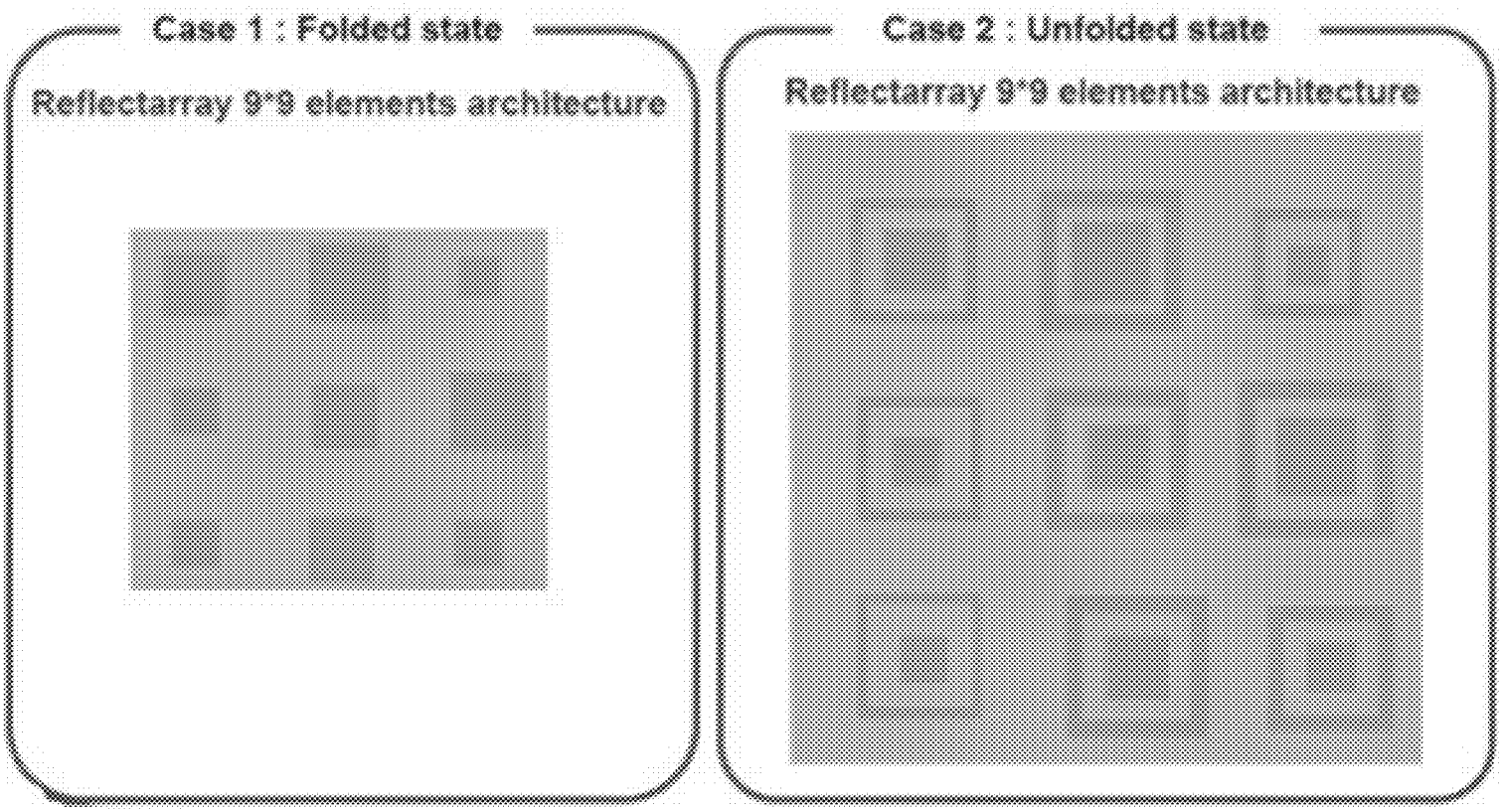
FIG. 7 shows top views of the array of FIG. 6, for both the folded state (labeled "Case 1") and the unfolded state (labeled "Case 2"). The modified unit cells in the unfolded state can be seen compared to the original unit cells in the folded state.
Figure 8:
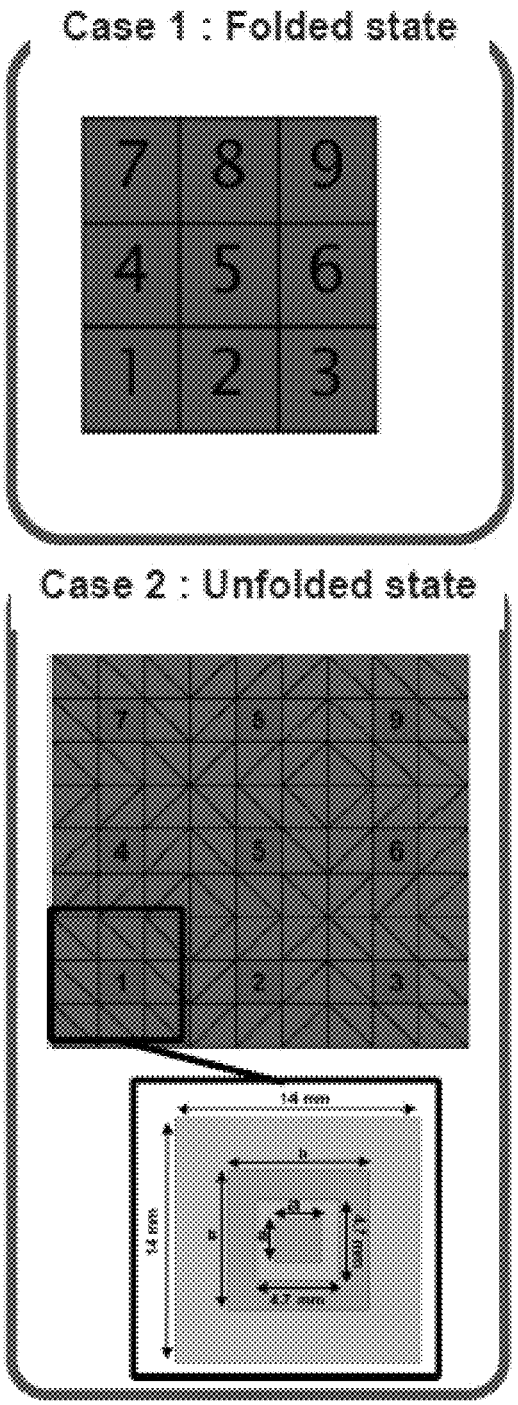
FIG. 8 shows top views of the array of FIGS. 6 and 7, for both the folded state (labeled "Case 1") and the unfolded state (labeled "Case 2"). The original unit cells are labeled as "1" through "9" for both cases, helping to demonstrate the modified unit cells in the unfolded state.

FIG. 6 shows top views of an array according to an embodiment of the subject invention, for both a folded state (labeled "Case 1") and an unfolded state (labeled "Case 2"). In the folded state all unit cells visible from above are optimized to steer in a particular direction and at a particular frequency (e.g., $\theta=0°$, $\phi=0°$, frequency=32 gigahertz (GHz)). In the unfolded state all unit cells from the folded state are visible from above, but they are now modified unit cells due to the portion of the substrate now surrounding the original unit cells (labeled "1" through "9" in FIG. 6). The modified unit cells are optimized to steer in a particular direction, which could be the same as the direction for the original unit cells in the folded state, and at a particular frequency (e.g., $\theta=0°$, $\phi=0°$, frequency=10.7 GHz). Although certain dimensions and arrangements (e.g., 9×9) are depicted in FIG. 6, these are shown for exemplary purposes only and should not be construed as limiting. FIG. 7 shows top views of the array of FIG. 6, for both the folded state (labeled "Case 1") and the unfolded state (labeled "Case 2"). The modified unit cells in the unfolded state can be seen compared to the original unit cells in the folded state. FIG. 8 shows top views of the array of FIGS. 6 and 7, for both the folded state (labeled "Case 1") and the unfolded state (labeled "Case 2"). The original unit cells are labeled as "1" through "9" for both cases, helping to demonstrate the modified unit cells in the unfolded state.

Figure 9:
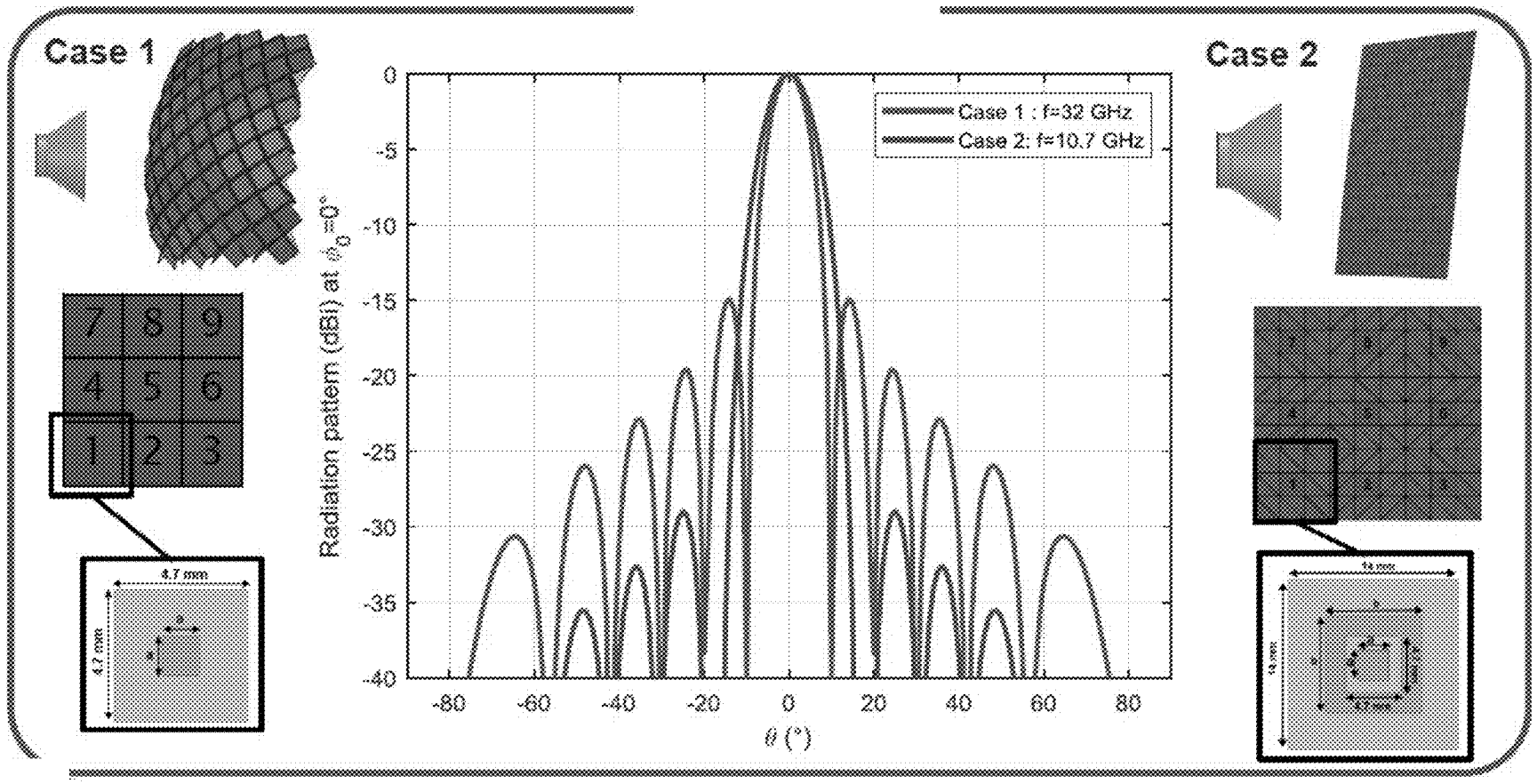
FIG. 9 is a plot of radiation pattern at $\phi_0=0^0$ (in dBi) versus $\theta$ (in degrees), for the two cases depicted in FIGS. 6 and 7. Case 1 operates at a frequency of 32 GHz, and Case 2 operates at a frequency of 10.7 GHz. Case 1 is the curve that is at about −31 dBi at $\theta$=about −65°, and Case 2 is the curve that is at about −36 dBi at $\theta$=about −50°.

FIG. 9 is a plot of radiation pattern at $\phi_0=0°$ (in dBi) versus $\theta$ (in degrees), for the two cases depicted in FIGS. 6 and 7. Case 1 operates at a frequency of 32 GHz, and Case 2 operates at a frequency of 10.7 GHz. Case 1 is the curve that is at about −31 dBi at $\theta$=about −65°, and Case 2 is the curve that is at about −36 dBi at $\theta$=about −50°. Referring to FIG. 9, the array steers the beam in the same direction in both the folded and unfolded states but at different respective frequencies in these two states.

Figure 10:
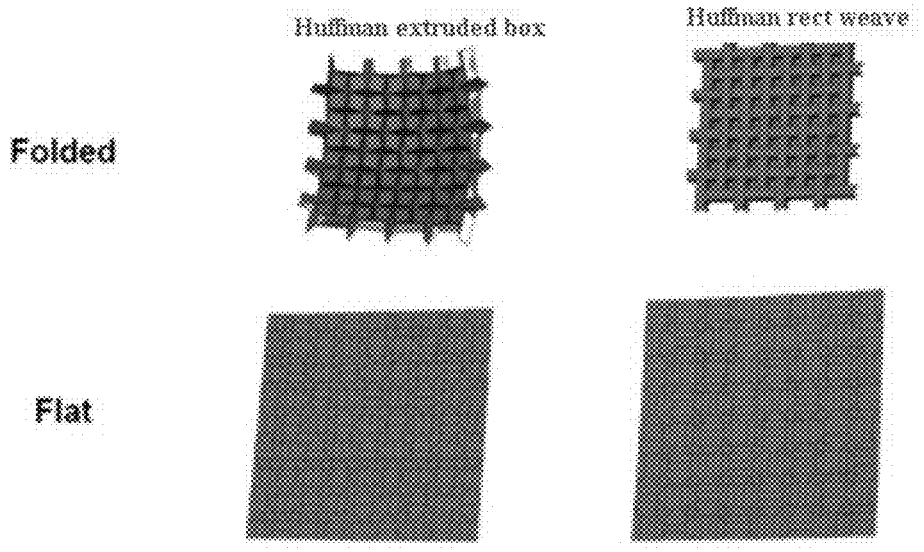
FIG. 10 shows two examples of foldable substrates, in both a folded state and an unfolded (labeled "flat") state, that can be used in an array according to embodiments of the subject invention. A first type of Huffman extruded box is shown in the first column, and a Huffman rectangular weave is shown in the second column.
Figure 11:
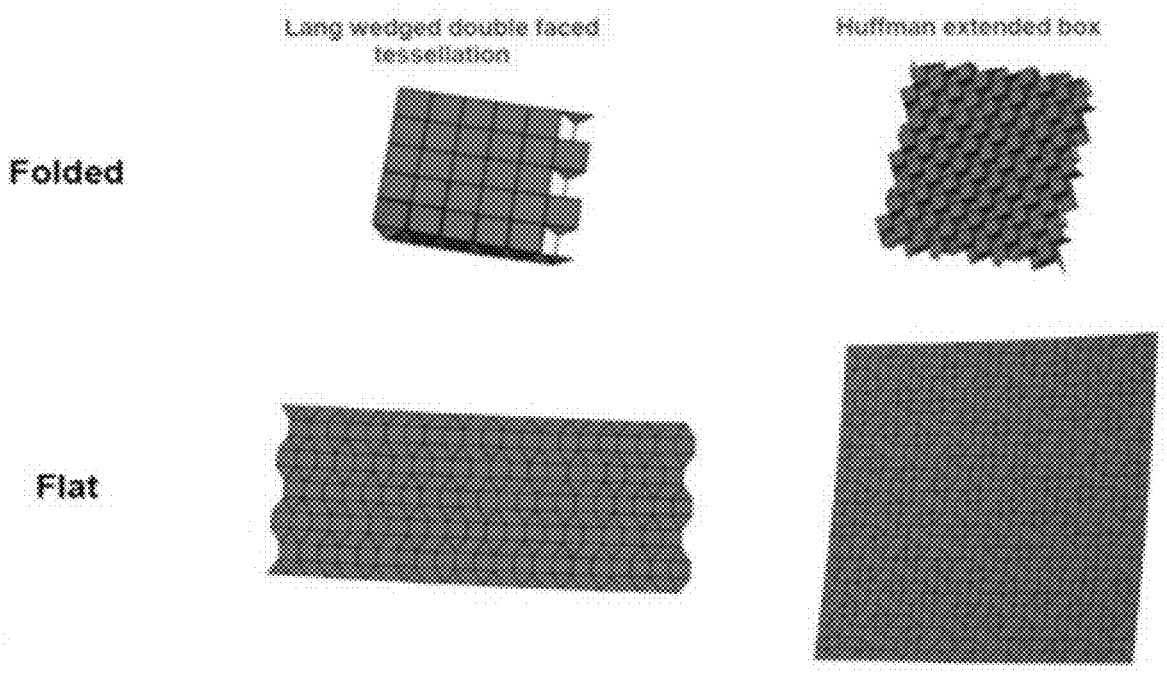
FIG. 11 shows two examples of foldable substrates, in both a folded state and an unfolded (labeled "flat") state, that can be used in an array according to embodiments of the subject invention. A Lang wedged double faced tessellation is shown in the first column, and a Huffman extended box is shown in the second column.

Embodiments of the subject invention can use foldable substrates with any foldable (e.g., origami design). FIGS. 10 and 11 show examples of foldable substrates, in both a folded state and an unfolded (labeled "flat") state, that can be used in an array according to embodiments of the subject invention. Referring to FIG. 10, a first type of Huffman extruded box is shown in the first column, and a Huffman rectangular weave is shown in the second column. Referring to FIG. 11, a Lang wedged double faced tessellation is shown in the first column, and a Huffman extended box is shown in the second column. The Huffman rectangular weave, the Lang wedged double faced tessellation, the Huffman extended box, and the Huffman extruded box are origami configurations that are known in the art of origami.

In an embodiment, a method for beamsteering and/or otherwise modifying the EM characteristics of an array can comprise providing an array as described herein and then using it with an antenna (i.e., changing its folding state as desired to modify the EM characteristics).

Embodiments of the subject invention can reconfigure their electromagnetic characteristics (including but not limited to the frequency of operation, the polarization, and the beam direction) and can also provide several array configurations that are efficiently present in a single substrate. The arrays can change their shape through folding, enabling them to reconfigure performance and provide multi-functionality and an additional degree of freedom, such that the user can direct the beam in the desired direction and/or use a desired frequency and not have to rely only on the electronic configuration that is conventionally used. The arrays can reconfigure their electromagnetic performance (e.g., beamsteering, polarization reconfigurability, frequency reconfigurability) by folding a combination of the foldable panels to change the electromagnetic design (layout). Use of such arrays provides new capabilities to communication systems (e.g., satellite communications systems). Embodiments of the subject invention can be used in several fields, including but not limited to multi-functional communications, satellite communication systems, and deployable and collapsible arrays.

It should be understood that the examples and embodiments described herein are for illustrative purposes only and that various modifications or changes in light thereof will be suggested to persons skilled in the art and are to be included within the spirit and purview of this application.

All patents, patent applications, provisional applications, and publications referred to or cited herein are incorporated by reference in their entirety, including all figures and tables, to the extent they are not inconsistent with the explicit teachings of this specification.

What is claimed is:

1. An array, comprising:

a foldable substrate configured to be folded and having predefined folding lines, hinges, or both, for folding into at least one predetermined configuration, such that the foldable substrate has an unfolded state and at least one folded state;

a plurality of first unit cells disposed on the foldable substrate, each first unit cell comprising an antenna element; and a plurality of second unit cells disposed on the foldable substrate, each second unit cell comprising an antenna element, the foldable substrate being configured such that, in a first folded state only the plurality of first unit cells is fully visible from above the array while the plurality of second unit cells is not fully visible from above the array, and only the plurality of first unit cells radiate in the first folded state, the foldable substrate being configured such that, in the unfolded state both the plurality of first unit cells and the plurality of second unit cells are fully visible from above the array, and both the plurality of first unit cells and the plurality of second unit cells r n the unfolded state, and the array being a reflectarray or a phased array.

2. The array according to claim 1, the antenna elements of the plurality of first unit cells being configured to steer a beam in a first direction, and the antenna elements of the plurality of second unit cells being configured to steer a beam in a second direction different from the first direction.

3. The array according to claim 1, each first unit cell being a rectangular unit cell, a triangular unit cell, or a circular unit cell.

4. The array according to claim 1, each second unit cell being a rectangular unit cell, a triangular unit cell, or a circular unit cell.

5. The array according to claim 1, further comprising an actuation system configured to fold and unfold the foldable substrate.

6. The array according to claim 5, the actuation system comprising a motor, robotics, or both.

7. The array according to claim 1, further comprising a plurality of third unit cells disposed on the foldable substrate, each third unit cell comprising an antenna element, the foldable substrate being configured such that, in a second folded state only the plurality of third unit cells is fully visible from above the array while the plurality of first unit cells and the plurality of second unit cells are not fully visible from above the array, and the foldable substrate being configured such that, in the unfolded state all of the plurality of first unit cells, the plurality of second unit cells, and the plurality of third unit cells are fully visible from above the array.

8. The array according to claim 7, each third unit cell being a rectangular unit cell, a triangular unit cell, or a circular unit cell.

9. The array according to claim 7, each third unit cell being a square unit cell.

10. The array according to claim 7, the antenna elements of the plurality of first unit cells being configured to steer a beam in a first direction, the antenna elements of the plurality of second unit cells being configured to steer a beam in a second direction different from the first direction, and the antenna elements of the plurality of third unit cells being configured to steer a beam in a third direction different from the first direction and the second direction.

11. The array according to claim 1, the at least one predetermined configuration comprising a waterbomb configuration, such that the first folded state is a waterbomb folded state.

12. The array according to claim 1, the at least one predetermined configuration comprising a Huffman extended box configuration, a Huffman extruded box configuration, a Huffman rectangular weave configuration, or a Lang wedged boule faced tessellation configuration, such that the first folded state is a Huffman extended box, a Huffman extruded box, a Huffman rectangular weave, or a Lang wedged boule faced tessellation.

13. An array, comprising:

a foldable substrate configured to be folded and having predefined folding lines, hinges, or both, for folding into at least one predetermined configuration, such that the foldable substrate has an unfolded state and at least one folded state;

a plurality of core unit cells disposed on the foldable substrate, each core unit cell comprising a first antenna element; and a plurality of modified unit cells disposed on the foldable substrate, each modified unit cell respectively comprising a core unit cell of the plurality of core unit cells, each modified unit cell further comprising a second antenna element around the first antenna element of its respective core unit cell to form a modified antenna element, the foldable substrate being configured such that, in a first folded state the first antenna element of each core unit cell of the plurality of core unit cells is fully visible from above the array while the second antenna elements are not fully visible from above the array, and only the plurality of core unit cells radiate in the first folded state, the foldable substrate being configured such that, in the unfolded state the plurality of modified unit cells, including the second antenna elements, is fully visible from above the array, and the plurality of modified unit cells radiate in the unfolded state, and the array being a reflectarray or a phased array.

14. The array according to claim 13, the first antenna elements being configured to steer a beam in a first direction at a first frequency, the modified antenna element of each modified until cell of the plurality of modified unit cells being configured to steer a beam in a second direction at a second frequency, and the first direction being different from the second direction, the first frequency being different from the second frequency, or both.

15. The array according to claim 13, each core unit cell being a rectangular unit cell, a triangular unit cell, or a circular unit cell, and each modified unit cell being a rectangular unit cell, a triangular unit cell, or a circular unit cell.

16. The array according to claim 13, further comprising an actuation system configured to fold and unfold the foldable substrate, the actuation system comprising a motor, robotics, or both.

17. The array according to claim 13, the at least one predetermined configuration comprising a waterbomb configuration, such that the first folded state is a waterbomb folded state.

18. The array according to claim 13, the at least one predetermined configuration comprising a Huffman extended box configuration, a Huffman extruded box configuration, a Huffman rectangular weave configuration, or a Lang wedged boule faced tessellation configuration, such that the first folded state is a Huffman extended box, a Huffman extruded box, a Huffman rectangular weave, or a Lang wedged boule faced tessellation.

19. The array according to claim 13, the first antenna elements being solid square antenna elements, and the second antenna elements being square-shaped antenna elements respectively surrounding the first antenna elements.

20. An array, comprising:

a foldable substrate configured to be folded and having predefined folding lines, hinges, or both, for folding into at least one predetermined configuration, such that the foldable substrate has an unfolded state and at least one folded state;

a plurality of first unit cells disposed on the foldable substrate, each first unit cell comprising an antenna element;

a plurality of second unit cells disposed on the foldable substrate, each second unit cell comprising an antenna element; and an actuation system configured to fold and unfold the foldable substrate, the foldable substrate being configured such that, in a first folded state only the plurality of first unit cells is fully visible from above the array while the plurality of second unit cells is not fully visible from above the array, the foldable substrate being configured such that, in the unfolded state both the plurality of first unit cells and the plurality of second unit cells are fully visible from above the array, the array being a reflectarray or a phased array, the antenna elements of the plurality of first unit cells being configured to steer a beam in a first direction, the antenna elements of the plurality of second unit cells being configured to steer a beam in a second direction different from the first direction, the actuation system comprising a motor, robotics, or both, each first unit cell being a rectangular unit cell, each second unit cell being a rectangular unit cell, and the at least one predetermined configuration comprising a waterbomb configuration, such that the first folded state is a waterbomb folded state.

* * * * *